United States Patent [19]

Vartan

[11] Patent Number: 4,689,905

[45] Date of Patent: Sep. 1, 1987

[54] COLLAPSIBLE LAUNDRY PRESS

[76] Inventor: Henri Vartan, 135 Seminary Dr., Apt. C, Mill Valley, Calif. 94941

[21] Appl. No.: 891,436

[22] Filed: Jul. 28, 1986

[51] Int. Cl.[4] ..... D06F 71/02; D06F 71/16

[52] U.S. Cl. ..... 38/26; 38/28; 38/42; 38/71; 38/136; D32/9; 108/41; 312/258

[58] Field of Search ..... 38/112, 25–43, 38/1 A, 1 B, 1 C, 1 D, 71, 136, 17; 223/70; D32/9; 312/282, 258; 108/38, 39, 41

[56] References Cited

U.S. PATENT DOCUMENTS

| | | | |
|---|---|---|---|
| D. 281,029 | 10/1985 | Marrs | D32/9 |
| 2,405,491 | 8/1946 | Clark | 38/1 A |
| 3,137,953 | 6/1964 | Foster | 38/30 |
| 3,699,673 | 10/1972 | Foster et al. | 38/30 |
| 3,742,868 | 7/1973 | Garceau et al. | 108/39 |

*Primary Examiner*—Werner H. Schroeder
*Assistant Examiner*—Andrew M. Falik
*Attorney, Agent, or Firm*—Townsend and Townsend

[57] ABSTRACT

A laundry press of the type suitable for pressing all articles of apparel, especially shirts, is contained in a rectangular cabinet. The cabinet upon opening includes at least one panel member hinged at the bottom for bracing the cabinet in an upright position. The cabinet provides at its upper end the support structure for a buck and heated pressing plate for placing on the garments the desired press. The buck and heated pressing plate in turn fold upwardly from the cabinet and are supported so as to cantilever from the cabinet overlying the bracing panel member. The buck is provided with the capability of rotation with respect to the pressing plate. Thus, a garment once mounted to the buck can be pressed on all sides. The buck is provided with side arm members that fold outwardly to support a duality of function to the buck. First, the outwardly folding members expand the buck to enable pressing of virtually all sizes of shirts, coats and other abdominal garments. Secondly, the arms as folded can accommodate the arms of shirts and abdominal garments to enable pressing of the arm members on the same piece of pressing equipment that presses the body member.

11 Claims, 19 Drawing Figures

COLLAPSIBLE LAUNDRY PRESS

This invention relates to the pressing of clothes and more particularly to a collapsible press having a universal buck utilized in the pressing of virtually all garments.

BACKGROUND OF THE INVENTION

Conventional domestic pressing of garments is notorious for its tedium and classical inefficiency.

Commercial pressing advances over domestic pressing by using discrete pieces of equipment for discrete pressing jobs. While such equipment may suit mass production cleaning establishments, it is noted that as many as three specialized pieces of equipment can be utilized for pressing a single garment such as a shirt. Examples of such equipment include body presses, single cuff presses, single collar presses and single and dual sleeve presses.

SUMMARY OF THE INVENTION

A laundry press of the type suitable for pressing all articles of apparel, especially shirts, is contained in a rectangular cabinet. The cabinet upon opening includes at least one panel member hinged at the bottom for bracing the cabinet in an upright position. The cabinet provides at its upper end the support structure for a buck and heated pressing plate for placing on the garments the desired press. The buck and heated pressing plate in turn fold upwardly from the cabinet and are supported so as to cantilever from the cabinet overlying the bracing panel member. The buck is provided with the capability of rotation with respect to the pressing plate. Thus, a garment once mounted to the buck can be pressed on all sides. The buck is provided with side arm members that fold outwardly to support a duality of function to the buck. First, the outwardly folding members expand the buck to enable pressing of virtually all sizes of shirts, coats and other abdominal garments. Secondly, the arms as folded can accommodate the arms of shirts and abdominal garments to enable pressing of the arm members on the same piece of pressing equipment that presses the body member.

OTHER OBJECTS AND ADVANTAGES

An object of this invention is to disclose a universal press contained in a single upright cabinet usable in the home or small commercial environment. Specifically, the disclosed press is contained in an upright cabinet. The cabinet includes at least one enclosure wall hinged at the bottom of the cabinet and folding from the top to provide a support for holding the cabinet in an upright position. The pressing plate and buck are hinged at the top of the cabinet. They move outwardly from a contained position within the cabinet to a cantilevered position of support overlying the wall supporting the cabinet. The buck folds out from the cabinet on a hinge at the top of the cabinet. The buck is supported in cantilever fashion at right angles to the cabinet. The pressing plate is hinge supported from the top of the cabinet overlying the buck. The pressing plate moves downwardly onto the cantilevered buck to effect pressing.

An advantage of this aspect of the invention is that a press having a commercial quality buck and pressing plate is adapted to a small package. This press of reduced size may be readily used in a home or small commercial environment.

A further advantage of this invention is that the convenience of commercial pressing including a buck interacting with a pressing plate is for the first time provided to small users.

A second object of this invention is to disclose a universal buck which with simplified construction which accommodates abdominal garments such as shirts for pressing. According to this aspect of the invention, the buck having an essentially elongate elliptical cross section is rotatable with respect to the pressing plate. A garment mounted to the buck can be firmly pressed as to both sides by rotation of the buck without remounting to the garment.

The universal buck includes side members spanning outwardly to increase the effective section of the buck. In an expanded disposition, the arm members of the buck can accommodate abdominal garments of virtually all sizes. In short, large shirts and small shirts may be conveniently pressed on the disclosed buck.

Additionally, and in an expanded position, the arms of the bucks can have sleeves pressed on them.

Yet another object to this invention is to disclose a configuration of the buck and pressing plate wherein both the buck and pressing plate reciprocates relative to one another to prevent the arms or limbs from being pressed and burned. According to this aspect of the invention, an interior cabinet member folds to a cantilevered 90° disposition with respect to the face of the rectangular cabinet. Thereafter, the buck and the pressing plate telescope outwardly and away from the inner cabinet member.

The pressing plate is provided with small downward movement with respect to the buck. This small downward movement requires that the buck have the garment to be pressed mounted thereover first. The pressing plate then telescopes out over the garment. Pressing occurs.

An advantage of this aspect is that it is not possible for unskilled users (such as homemakers learning to operate the equipment) to have their arms or limbs in the interstices between the plate and buck. Consequently a commercial type press having safety features suitable for the home and amateur environment is disclosed.

BRIEF DESCRIPTION OF THE DRAWINGS

Other objects, features, and advantages will become more apparent after referring to the following specification and attached drawings in which:

Referring to FIG. 1 a cabinet C is shown braced by a leg L. A buck B having members 14, 16 for folding movement is confronted by a pressing plate P. Pressing plate P is provided with a central indentation 20. As can be seen, indentation 20 accommodates leg L when the press is in the folded configuration illustrated in FIG. 2a. Additionally, indentation 20 can include heat dissipation fins for discharge of excess heat. It will be noted that when the press is erected and in use, leg L is away from the indentation so that heat escape can occur.

Figure 2A:
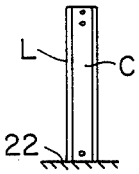
FIGS. 2*a*–2*e* are a cartoon side elevation series illustrating the erection of the press of FIG. 1 from its stored disposition.
Figure 2B:
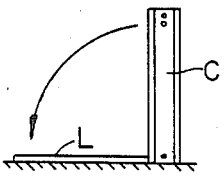

Erection of the unit can be easily understood. The vertical cabinet C is provided with a leg L hinged at the bottom corner 22 of the cabinet. Leg L moves downwardly to confrontation with the ground to provide a "L" shaped support to the cabinet (see FIG. 2b).

Figure 2C:
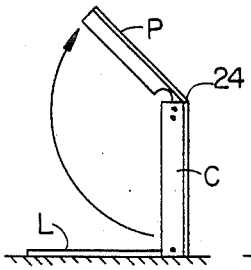
Figure 2D:
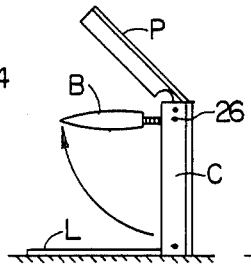
Figure 2E:
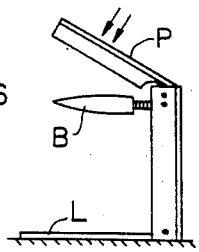

Referring to FIG. 2c, pressing plate P is hinged to the upper portion of the cabinet at axis 24. Likewise referring to FIG. 2d, buck B is hinged to the cabinet C at a hinged axis 26. Preferably buck B moves to a position at 90° with respect to the cabinet C.

Finally, and once the press plate P is conventionally heated, preferably by electrical resistance monochrome wiring, pressing occurs by the hinged movement of the pressing plate P to and from a position of confrontation with respect to the buck B.

Figure 1:
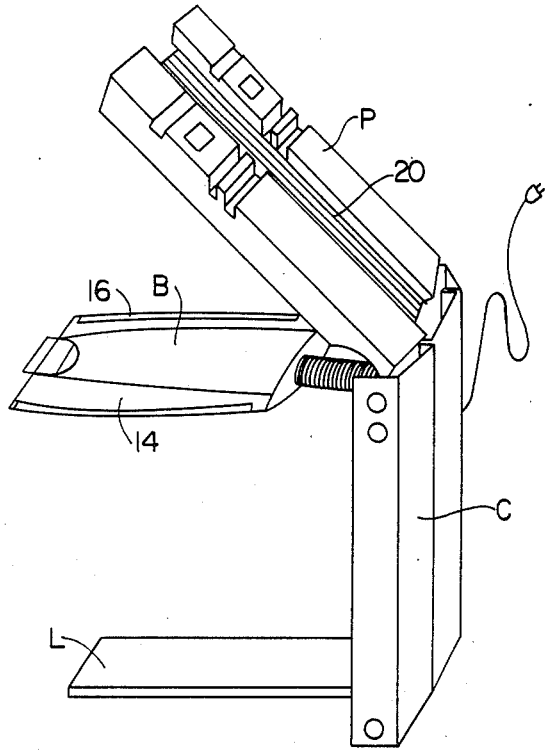
FIG. 1 is a perspective view of an embodiment of this invention illustrating the supported cabinet holding the rotating buck and hinged pressing plate of this invention.
Figure 3A:
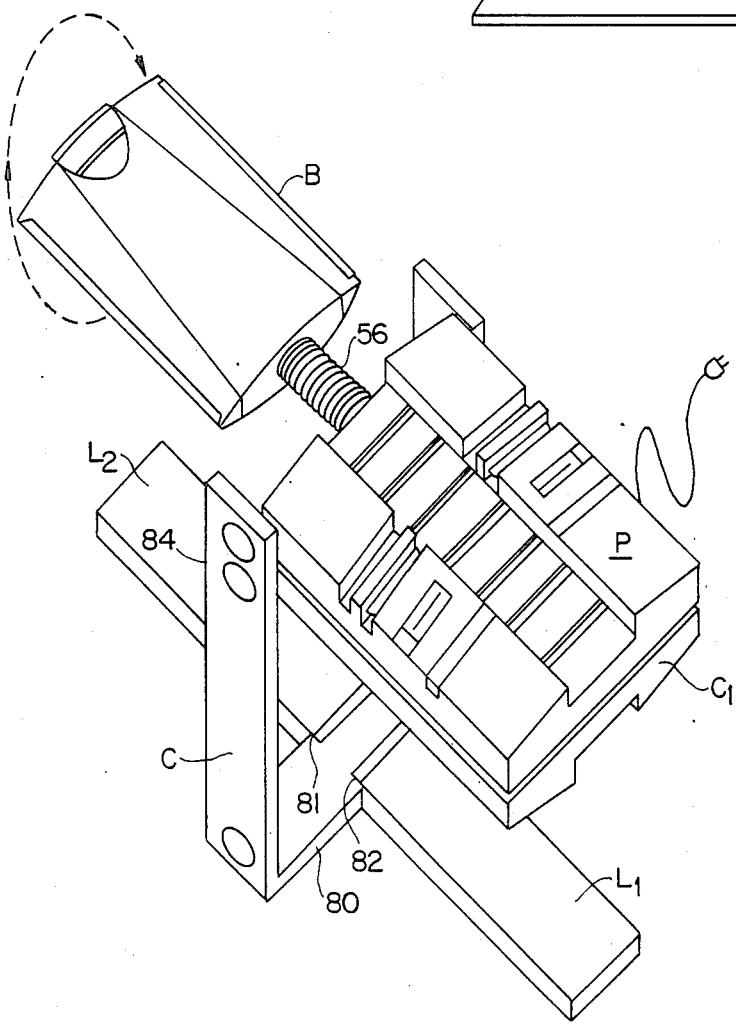
FIG. 3*a* is a perspective view of the erected press having the rotating buck and pressing plate telescoping outwardly over the buck to provide minimal risk of user limbs being caught in the pressing interface.
Figure 5A:
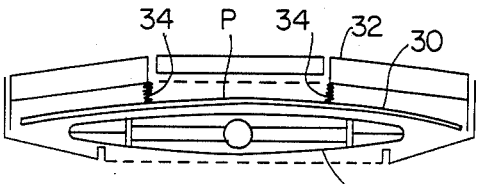
FIGS. 5*a*–5*c* are respective side elevation sections, half elevation sections and plan sections of the buck of this invention.

Referring back to FIG. 1, it will be realized that buck B is rotatable with respect to cabinet C. Preferably, the buck B is supported on at least two telescoping large diameter plated supporting pipes. These pipes rotate one with respect to another to permit the buck B to rotate with respect to the pressing plate P. Referring to FIG. 5a, a section is taken across the buck B and pressed plate P illustrating the press of this invention. Specifically, a highly polished chrome plate 30 heated with conventional monochrome electric resistance wiring with a connected conventional thermostatic control (not shown) is spring mounted with respect to a supporting structure 32 by respective springs 34. It will be understood that springs 34 are distributed from support plate 32 to equalize the applied pressure so that the plate 30 bears on the buck B with essentially uniform force.

The reader will note that I illustrate cantilevered supports. In practice, the pressing forces are not particularly great. What is important is that the force applied be essentially evenly distributed over the garment, a function provided by the springs.

Figure 5B:
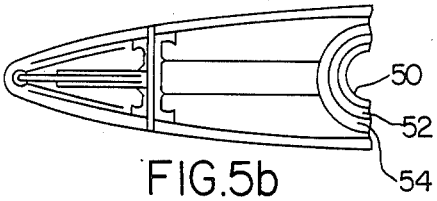
Figure 5C:
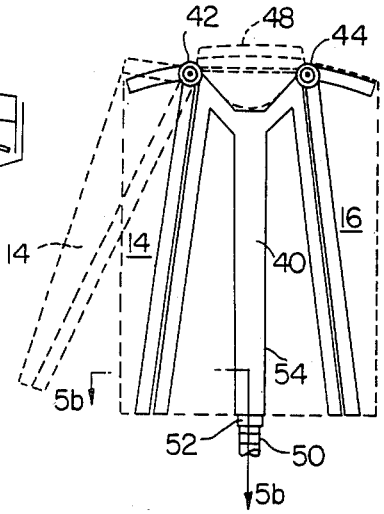

Referring to FIG. 5c, a plan view of the buck is illustrated. The buck as seen in FIGS. 5a, 5b has an overall elliptical configuration of high eccentricity in section. The buck includes paired arms 14, 16. Arms 14, 16 move in pivoted relation with respect to a central body 40. Such movement occurs at spring hinges 42 for arm 14 and 44 for arm 16. Preferably, the buck is provided with a thermally insulated handle 48. Handle 48 can be used to cause the buck to rotate once the pressing plate P is clear of the buck.

The respective arms 14, 16 include conventional spring latches co-acting with the hinge. In a first position, the spring latches hold the respective arms 14, 16 in side-by-side relationship to the member 40. In a second position, the latch allows the arms 14, 16 to spring away from the central member 40. Such springed movement is preferred up to a limit of approximately 20° as illustrated in broken lines on arm 14 in FIG. 5c.

Preferred support of the buck occurs at concentric pipes 50, 52, 54. These concentric pipes permit rotation of the buck around its central axis. Additionally, and as will be illustrated with respect to FIG. 4d, by making the respective pipes 54, 52, 50 telescope, one with respect to another, the mount can accommodate towards and away movement of the buck from a supporting cabinet C.

Figure 6A:
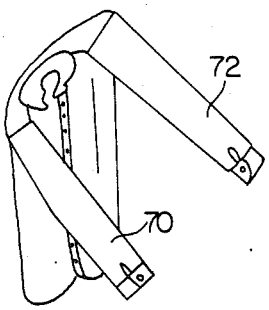
FIGS. 6a–6c indicate sequentially the pressing of a body garment member, here a shirt.

Having described an embodiment of the disclosed press, the process of pressing of a shirt utilizing the press of this invention can be illustrated. Referring to FIG. 6a, the sleeves 70, 72 of a shirt are extended. The sleeves are preferably threaded to the arms 14, 16 as they are pivoted outwardly and away from the buck member B. They are thereafter pressed.

Figure 6B:
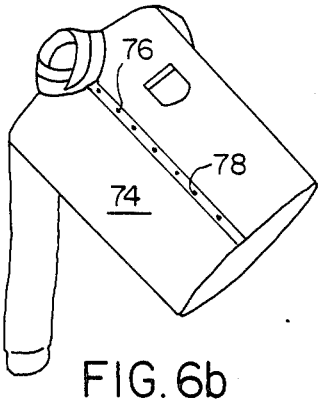

Referring to FIG. 6b, a shirt torso 74 is fastened as by the coupling of one or more buttons 76, 78 over the surface of the buck. Pressing on a first side occurs. Thereafter, the buck is rotated and pressing on a second side occurs.

The reader will understand that the buck B, as illustrated in FIG. 5c, is expansible. Thus, even where the shirt 74 is of large size, the buck will expand the volume of the shirt in a linear disposition so that the fabric of the shirt is confronted in a substantially linear disposition to the pressing plate P.

The buck is provided with an arcuate end in the vicinity of handle 48. By the expedient of overlying the collar 79 at the arcuate end, pressing of the collar 79 occurs as a final step.

Figure 6C:
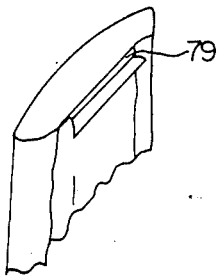

In each pressing configuration illustrated in FIGS. 6a–6c, the reader will understand the buck supports the shrit in the illustrated configurations as the pressing plate contacts the buck and effects the press.

Referring to FIGS. 3a and 4a–4e an alternate embodiment of the press is illustrated. Specifically, the cabinet member C includes a U-shaped frame 80. U-shaped frame 80 has legs L1 and L2 hinged at hinges 81, 82 to the central member 80 of cabinet C. Legs L1, L2 when folded downwardly support the member C to prevent its movement in either direction.

An inner cabinet member C1 hinges at an axis 84 at the top of the legs of U-shaped cabinet member C. Typically, member C1 is held at a 90° angle or parallel to legs L1, L2.

Buck B is mounted on telescoping pipes 50, 52, 54. As mounted on these respective telescoping pipes, the buck may be moved into and out of cabinet member C1. (See FIG. 3b.) Preferably, the respective telescoping pipes are covered by a cover member 56, this cover member being of an accordion sleeve.

Figure 3B:
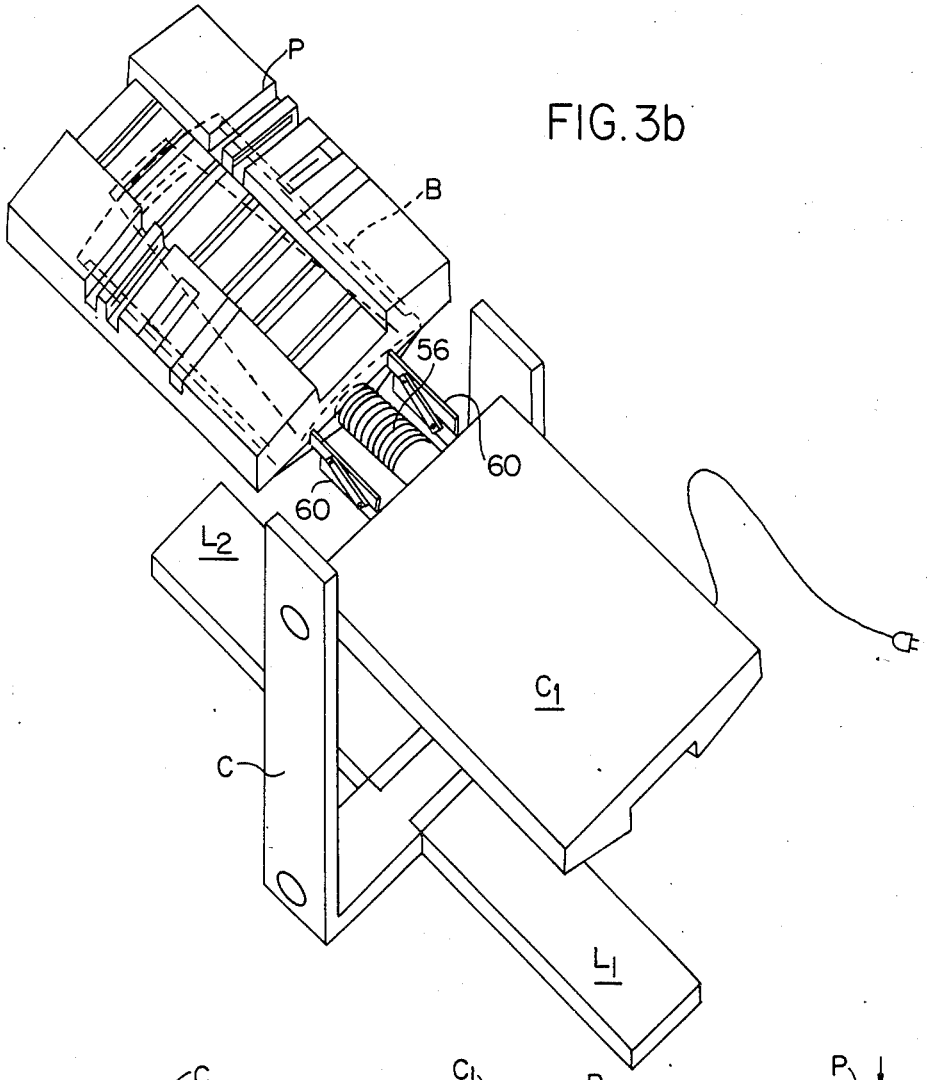
FIG. 3*b* is a view of the press of FIG. 3*a* showing the pressing of a garment.

Referring further to FIG. 3b, press plate P in turn slides over buck B through the hinge means 60. The cabinet member C1 includes press plate P within its top portion.

Press plate P is conventionally mounted from cabinet member C1 on paired parallel rule supports on either side (not shown). These parallel rule supports enable the press plate P to move in a parallel disposition over cabinet member C1 and buck B while maintaining the press plate P parallel to the buck B.

Erection of the apparatus can be easily understood.

Figure 4A:
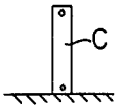
FIGS. 4*a*–4*e* are a cartoon series of the direction of the apparatus of FIG. 3.
Figure 4B:
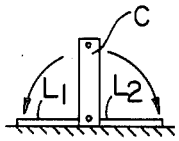
Figure 4C:
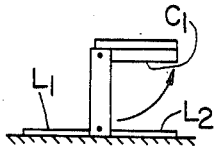

Referring to FIG. 4a, the cabinet C has legs L1, L2 fold downwardly and brace the cabinet C. Thereafter, the inner cabinet member C1 folds upwardly and is supported at the top of the cabinet.

Figure 4D:
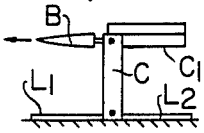
Figure 4E:
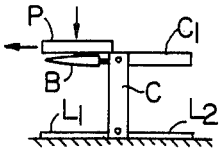

Referring to FIG. 4d, buck B telescopes out of cabinet C1. Referring to FIG. 4e, the press plate P first telescopes on drawer glides overlying buck B. Thereafter, either buck B or alternately press plate P can be moved towards one another to effect pressing. Such movement can include spring mounting of the drawer guides on cabinet C1 or upward rotation of the buck B into contact with press plate P.

Referring to the embodiments of FIG. 3 and FIGS. 4*a*–4*e*, the reader will realize that the disclosed embodiment of FIG. 4*e* leaves little room in the interstices between the press plate P and the buck B when the press plate P is pulled outwardly overlying the buck B for pressing. Thus, for the relatively unskilled user, movement of the hands into the interstices between the buck B and the plate P is nearly impossible.

It will be also realized that I have illustrated here the pressing of shirts, the most commonly difficult garment to press. It will be understood that coats and other sleeved abdominal garments can likewise be pressed. It goes without saying that all other garments may be similarly pressed.

In the illustrations herein disclosed, I contemplate pressing by heat or heat and steam. It being left to the routineer to provide steam outlet. Conventional wetting of the garments as by sprinkling before pressing can as well occur.

What is claimed is:

1. A laundry press comprising:

a cabinet having at least one side member and a upright member, said said member side foldable from a first position, closing said cabinet to a second position at substantial right angles to said cabinet to brace said cabinet in an erect position;

a buck movable from a first position interior of said cabinet upright member where it may be enclosed by a further member of said cabinet to a second position at substantial right angles to and supported from the top of said cabinet;

a pressing plate supported from said top of said cabinet upright member overlying said buck, said pressing plate being movable towards and away from confrontation with said buck to press garments supported on said buck;

said buck and pressing plate mounted for reciprocation outwardly from said further member of said cabinet, said further member of said cabinet supported at 90° to said cabinet.

2. The invention of claim 1 and wherein said pressing plate moves on a hinge overlying said buck towards and away from said buck.

3. The invention of claim 1 and wherein said buck rotates with respect to said cabinet and pressing plate.

4. The invention of claim 1 and wherein two said side members fold and hinge from the bottom of said cabinet to support said cabinet from both sides.

5. The invention of claim 1 and wherein said buck includes first and second arms, said arms hinged to one end of said buck and expanding outwardly of said buck to change the effective cross section of said buck.

6. A laundry press comprising:

a cabinet having at least one side member and a upright member, said side member foldable from a first position, closing said cabinet to a second position at substantial right angles to the cabinet to brace said member in a horizontal working position;

a buck movable from a first position interior of said cabinet upright member where it may be enclosed by a further member of said cabinet to a second position at substantial right angles to and supported from the top of said cabinet; a pressing plate supported from the top of the cabinet upright member overlying said buck, said pressing plate being movable towards and away from confrontation with said buck to press garments supported on said buck; said buck rotatable under said pressing plate for exposing to said pressing plate alternative sides of said buck whereby said pressing plate can press a garment on said buck on first and second sides of said buck upon rotation of said buck.

7. The invention of claim 6 and wherein said buck includes at least one member mounted at the side of said buck, said member having a first portion exposed to the first side of said buck and a second portion exposed at the second side of said buck; said mounted member of said buck movable towards and away from the remainder of said buck to expand the section of said buck.

8. The invention of claim 7 and wherein said buck includes two members movable towards and away from the central portion of said buck.

9. A laundry press comprising: a cabinet having at least one side member, said side member foldable from a first position closing said cabinet to a second position at substantial right angles to said cabinet; a buck movable from a first position interior of said cabinet where it may be enclosed by a member of said cabinet to a second position at substantial right angles to and supported from the top of said cabinet; a pressing plate supported from the top of said cabinet overlying said buck, said pressing plate being movable towards and away from confrontation with said buck to press garments supported on said buck; said buck including at least one expandable member, said member movable towards and away from the remaining portion of said buck to expand the cross section of said buck.

10. The invention of claim 9 and wherein said buck includes two members, each of said members movable towards and away from the central portion of said buck to expand said buck.

11. The invention of claim 9 and wherein said buck includes first and second sides for pressing said garment on said pressing plate;

means mounting said buck for rotation with respect to said pressing plate whereby said first and second sections can be successively confronted to said pressing plate to press a garment mounted over said buck.

* * * * *